US005810659A

United States Patent [19]

Kim

[11] Patent Number: 5,810,659

[45] Date of Patent: Sep. 22, 1998

[54] OPENING ANGLE ADJUSTING APPARATUS OF AN AUTOMATIC SUCTION GRILLE

[75] Inventor: Jong-Whal Kim, Suwon, Rep. of Korea

[73] Assignee: Samsung Electronics Co., Ltd., Suwon, Rep. of Korea

[21] Appl. No.: 813,435

[22] Filed: Mar. 10, 1997

[30] Foreign Application Priority Data

Mar. 21, 1996 [KR] Rep. of Korea ..... 96-7780

[51] Int. Cl.[6] ..... F24F 13/15

[52] U.S. Cl. ..... 454/233; 454/318; 454/335

[58] Field of Search ..... 454/230, 231, 454/233, 234, 318, 325, 335, 351, 352, 363

[56] References Cited

U.S. PATENT DOCUMENTS

| | | | |
|---|---|---|---|
| 1,737,946 | 12/1929 | Rood | 454/335 |
| 2,135,810 | 11/1938 | Germonprez | 454/318 |
| 2,293,065 | 8/1942 | Kiczales | 454/335 |
| 3,202,079 | 8/1965 | Steiner | 454/363 X |

FOREIGN PATENT DOCUMENTS

| | | | |
|---|---|---|---|
| 63-286650 | 11/1988 | Japan | 454/233 |
| 739895 | 11/1955 | United Kingdom | 454/335 |

*Primary Examiner*—Harold Joyce
*Attorney, Agent, or Firm*—Burns, Doane, Swecker & Mathis, L.L.P.

[57] ABSTRACT

An air conditioner cabinet includes an air inlet and an air outlet. A U-shaped frame is mounted to the cabinet such that parallel vertical legs of the frame straddle the inlet. A pair of links are arranged for vertical sliding movement adjacent respective ones of the legs. Vertically spaced blades are mounted to the frame and extend across the inlet. The blades are mounted to the links such that vertical movement of the links causes the blades to pivot between inlet-opening and inlet-closing positions. The blades pivot through different respective angles whereby the inlet is opened by progressively greater amounts from the top to the bottom of the inlet.

3 Claims, 6 Drawing Sheets

OPENING ANGLE ADJUSTING APPARATUS OF AN AUTOMATIC SUCTION GRILLE

BACKGROUND OF THE INVENTION

1. Field of the Invention

The present invention relates to an air conditioner and especially to an opening/closing blade mechanism therefor.

2. Description of the Prior Art

As shown in FIG. 1, a conventional air conditioner has a front panel 3 provided at a front surface of a cabinet 1 forming an external appearance of the air conditioner, and a suction inlet 5 integrally provided therewith below the front panel 3 for taking in a room air into the cabinet 1.

A discharge outlet 7 is provided above the front panel 3, the latter having at a lower portion thereof an operation manipulating portion 9 for establishing operation conditions for the air conditioner.

The suction inlet 5 is provided with a suction grille member 11 for protecting the suction inlet 5 from the external environment. The discharge outlet 7 is provided with air blowing direction adjusting means 12 for controlling directions in blowing the heat-exchanged air indoors through the discharge outlet 7, wherein the means 12 consists of vertical plates 15 for vertically adjusting blowing directions for the air to be discharged and horizontal plates 13 for horizontally adjusting the blowing direction.

Referring to FIG. 2, upon a rear portion of the suction grille member 11 is mounted a filtering member(not shown) used for filtering any foreign substances contained in the air sucked through the suction inlet 5. The operation manipulating portion 9 is operatively coupled to control means 19 which is inwardly disposed adjacent to the operating manipulating portion 9.

The air conditioner has a heat-exchanger for heat-exchanging the room air introduced through the suction inlet, which is positioned in the air conditioner and over which a blower 23 usually activated by a motor (not illustrated) to promote the air flow is installed.

The suction grille member 11 is also provided with suction openings 11*a* which communicate with the suction inlet 5.

In operation of the conventional air conditioner LU thus constructed, if the commands from the operating manipulating portion 9 are delivered to the control means is 19, the specific operations related to the commands are performed under a control of the control means 19. The room air is sucked into the cabinet 1 through the suction openings 11*a* formed in the suction grille member 11, heat-exchanged by the heat-exchanger, and then discharged into the discharge outlet 7 for heating or cooling the room air.

The suction is produced by the blower 23. The room air taken in through the suction inlet 5 is filtered by the filter means 17, and the air to be discharged indoors is blown to the desired directions defined by the positional combination of the vertical and horizontal plates 15, 13 according to varied slants for both plates 13, 15.

However, there is a problem in the above-mentioned conventional air conditioner, in that, even though the filter means are employed, dusts and foreign substances may be deposited on the suction inlet 5. This is because the suction inlet is integrally and fixedly formed. Further, such a structure of the suction inlet results in an inconvenience in cleaning the suction inlet 5 and in a dusty appearance thereof, which gives rise to an unpleasant sense that the room air may be contaminated.

SUMMARY OF THE INVENTION

Therefore, it is an object of the present invention to provide an opening angle adjusting apparatus of an automatic suction grille which enables a user to effectively adjust the air flow being sucked, by an adjustment of an opening angle of the suction grille.

The above object is accomplished by an opening angle adjusting apparatus of an automatic suction grille used in an air conditioner, the apparatus comprising:

- a U-shaped suction grille frame fixedly secured at a front surface of a cabinet;
- a pair of sliding links to be insertedly fitted to both sides of suction grille frame;
- a plurality of blades, each being pivotally inserted into both the suction grille frame and the sliding links; and
- driving means for vertically moving the sliding links.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENT OF THE INVENTION

The preferred embodiment according to the present invention will now be described in detail with reference to drawings.

Figure 1:
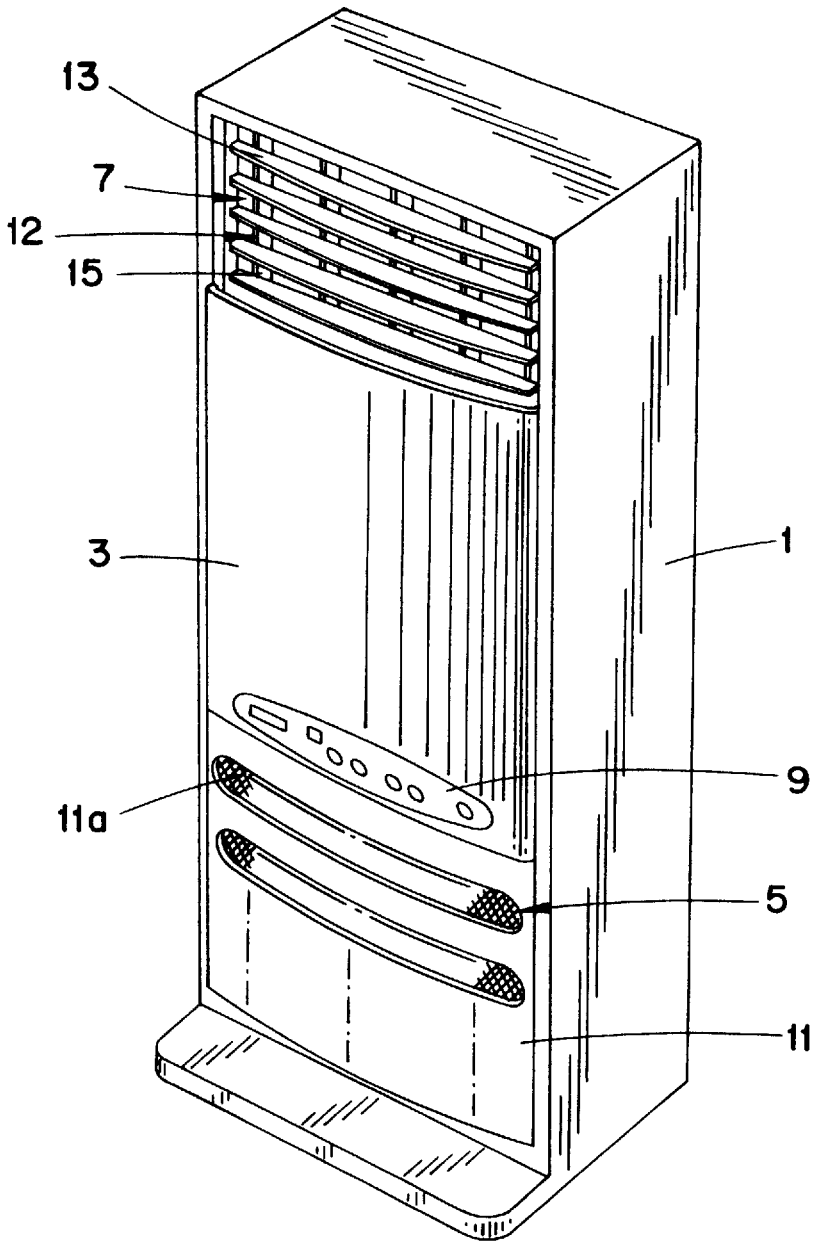
FIG. 1 (PRIOR ART)
FIG. 1 is a perspective view of a conventional air conditioner.
Figure 2:
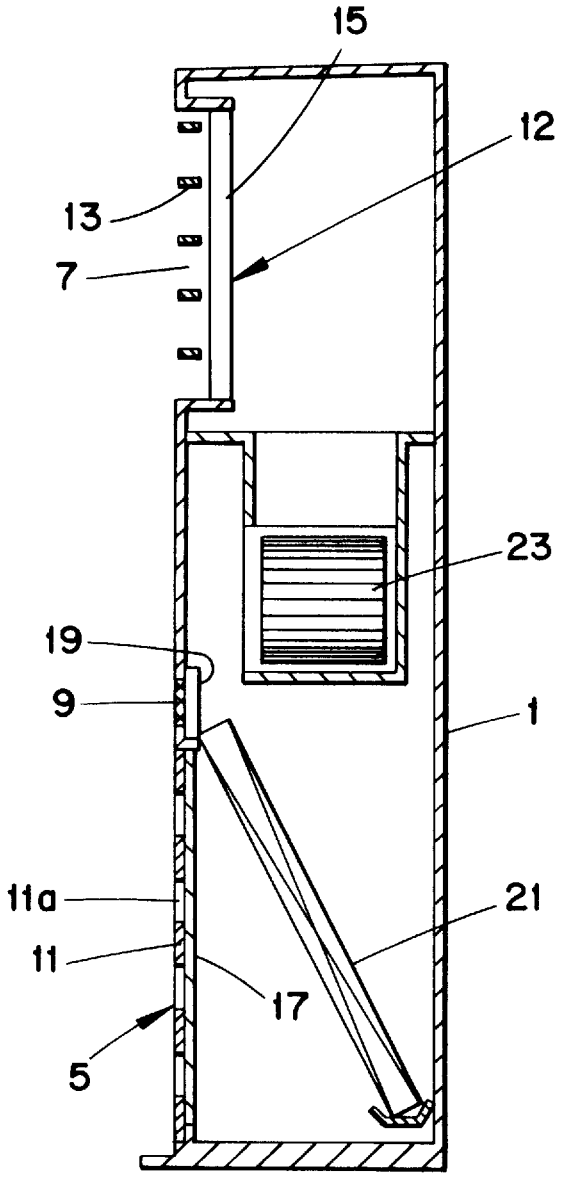
FIG. 2 (PRIOR ART)
FIG. 2 is a vertical sectional view of the conventional air conditioner in FIG. 1.
Figure 3:
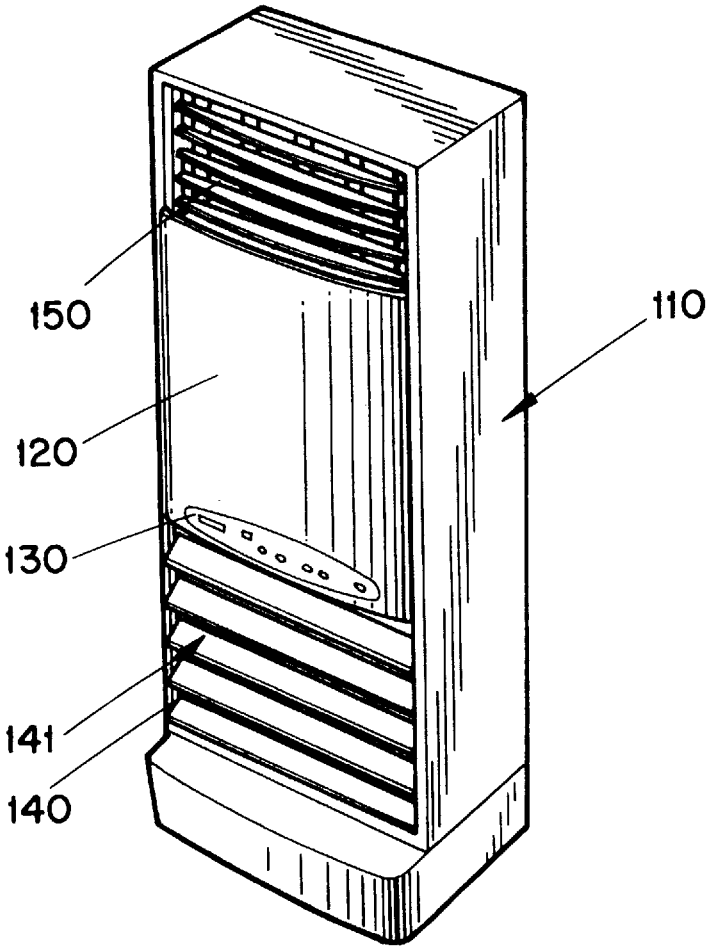
FIG. 3 is a schematic perspective view of an indoor unit for an air conditioner according to one embodiment of the present invention.

FIG. 3 shows a schematic perspective view of an indoor unit for an air conditioner according to one embodiment of the present invention. The air conditioner to which the present invention is applied includes, as shown in FIG. 3, a cabinet 110, a front panel 120 coupled to a central front portion of the cabinet 110, and a control unit 130 placed at a lower portion of the front panel 120, for controlling the air conditioner.

Further, a suction inlet 140 and a discharge outlet 150 are formed at respective lower and upper portions of the cabinet 110 for taking in a room air and for discharging indoors the heat-exchanged air, respectively.

Also, the discharge outlet 150 is provided with louvers for adjusting the blowing direction for cold air supplied into the room through the discharge outlet 150.

The suction inlet 140 formed at a lower portion of the front panel 120 is provided with an automatic suction grille member 141, which is usually designed to give a good appearance thereto, for supporting a filtering member (not shown).

Figure 4:
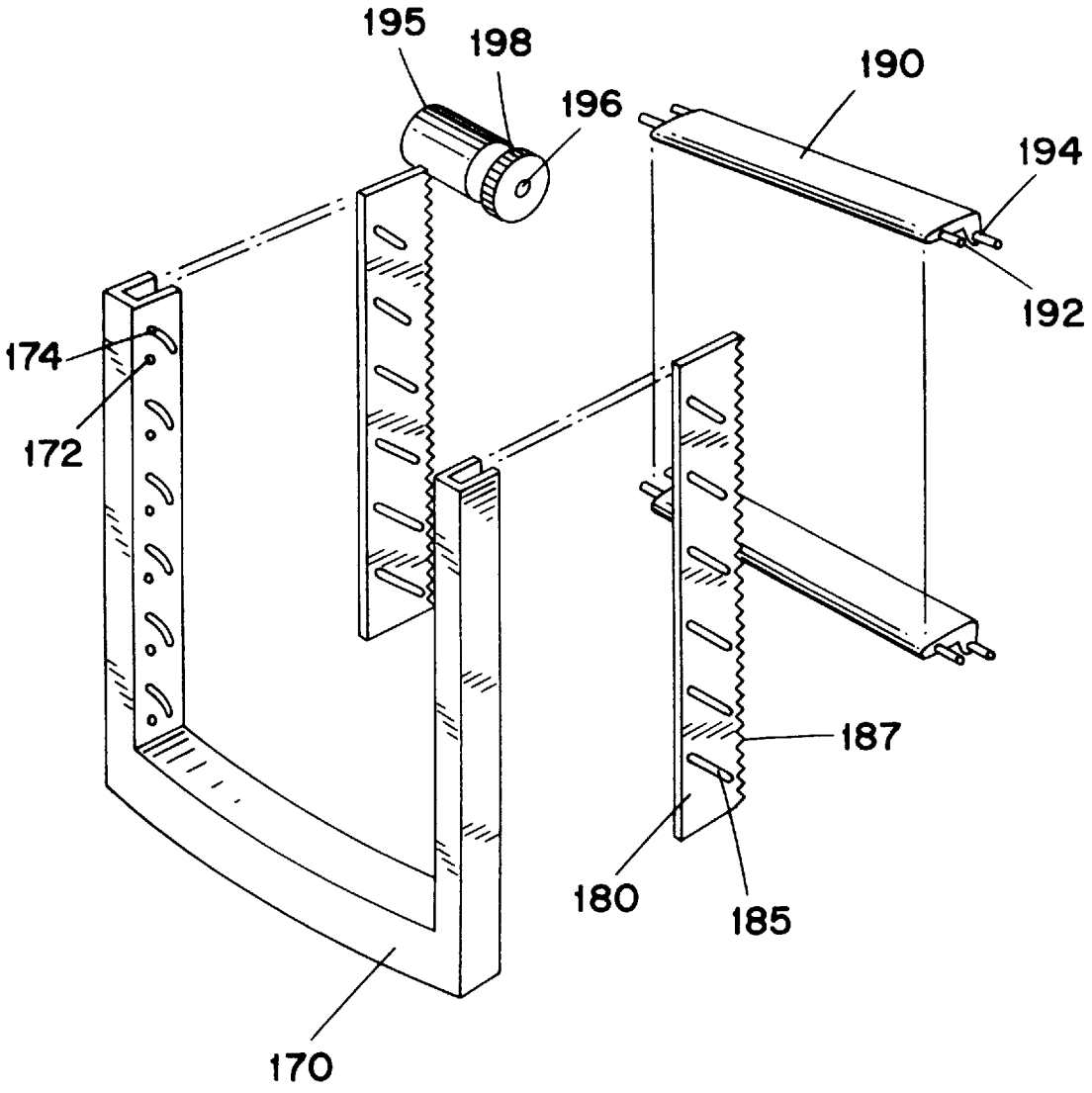
FIG. 4 is an exploded perspective view of an opening angle adjusting apparatus of an automatic suction grille.

FIG. 4 is a perspective view of the opening angle adjusting apparatus of the automatic suction grille.

As shown in FIG. 4, the preferred apparatus includes a U-shaped suction grille frame 170 fixedly secured at a front surface of the cabinet 110, a pair of sliding links 180 to be fitted in both sides of suction grille frame 170, a plurality of blades 190, each being pivotally inserted into both the suction grille frame 170 and the sliding links 180, and driving means 195 for vertically moving the sliding links 180.

The U-shaped suction grille frame 170 has at both sides or legs thereof a plurality of blade fixing shaft receiving co holes 172 and blade moving shaft receiving slots 174 for respectively inserting a plurality of blade fixing shafts 192 and blade moving shafts 194 formed at both sides of the respective blades 190, wherein each of the moving shaft receiving slots 174 is shaped like a crescent.

The sliding link 180 is provided with a plurality of vertically spaced straight slide link slots 185, each being inclined obliquely relative to vertical. Each slot 185 is different in size and each link is provided at one side thereof with a rack 187 allowing the sliding link 180 to be moved in correspondence to movements of a respective pinion 198 (only one pinion 198 depicted in FIG. 4). The rack 187 engages the pinion 198 which is pivotally inserted into a shaft of a driving motor 195.

Each blade 190 has at each end thereof a blade fixing shaft 192 and a blade moving shaft 194, separated from each other by a predetermined distance.

Figure 5:
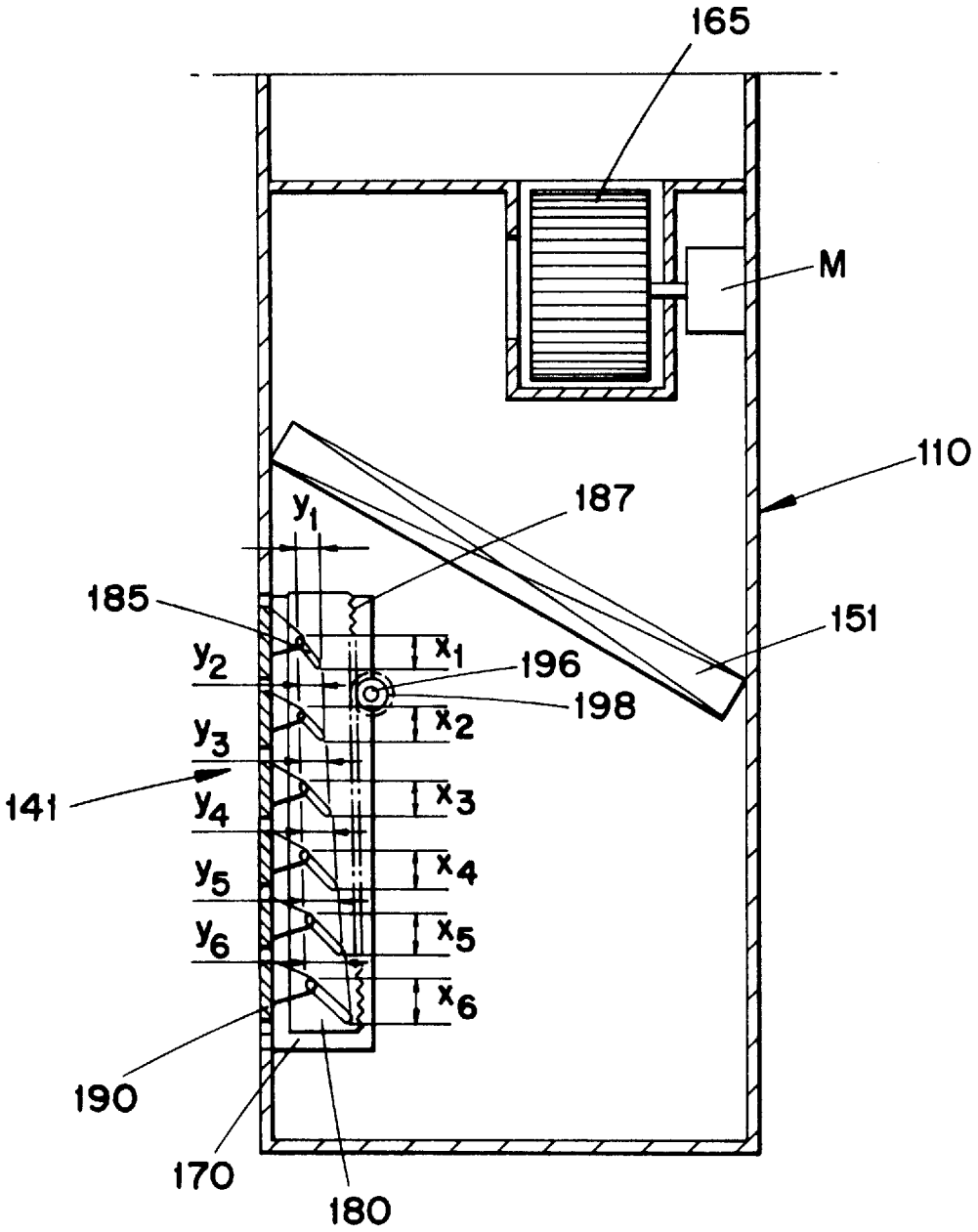
FIGS. 5 and 6 are partial cross-sectional views of the air conditioner in which the automatic suction grille of the present invention is shown as closed and opened, respectively.
Figure 6:
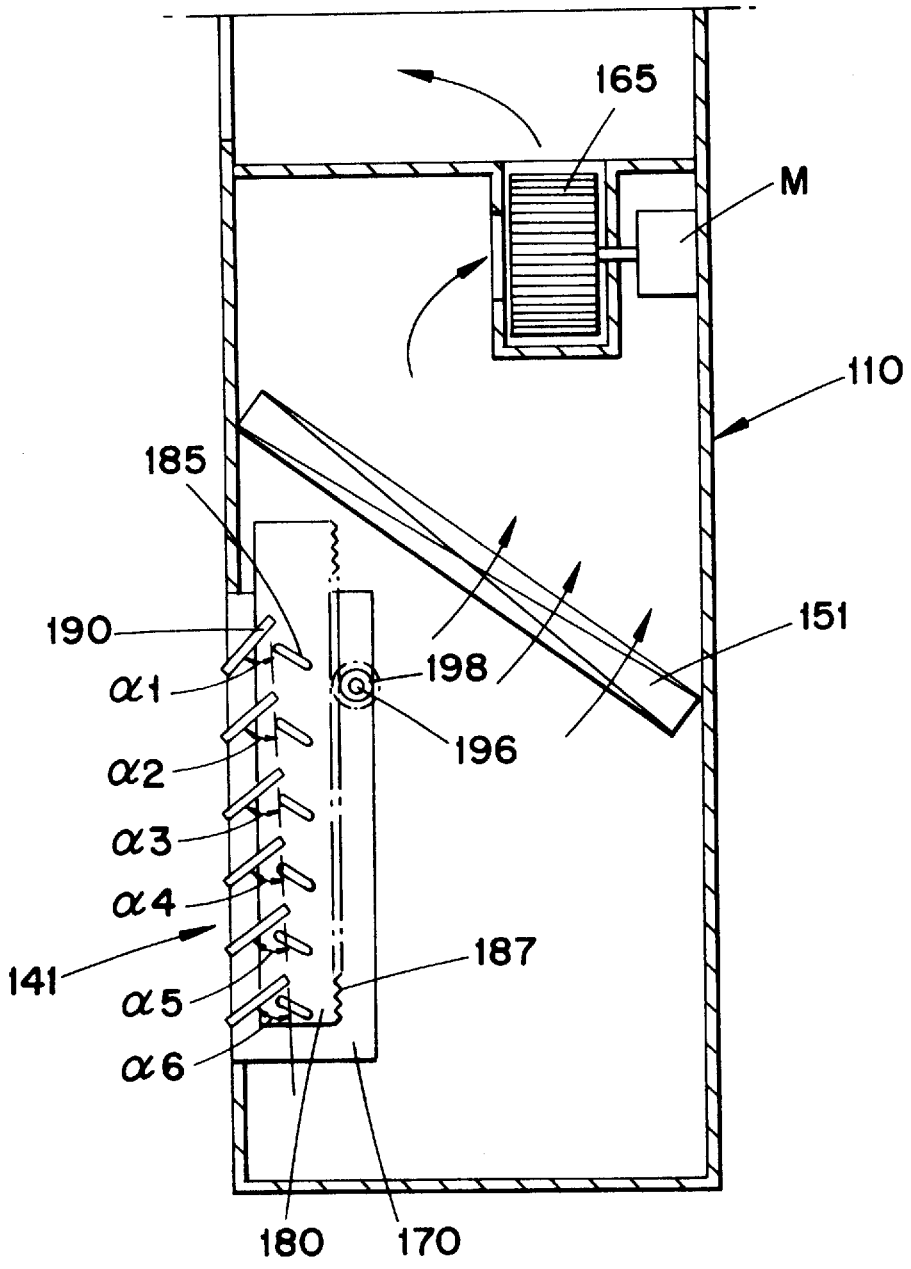

FIGS. 5 and 6 are partial cross-sectional views in the air conditioner of which the automatic suction grille of the present invention is closed and opened, respectively.

As shown in the drawings, the suction inlet 140 formed at the lower portion of the front panel 120 is provided with the automatic suction grille member 141, which is usually designed to present a good appearance and for supporting a filtering member(not shown). A heat-exchanger 151 is slantly positioned within the air conditioner, and is provided with a blower 165 activated by a motor M to promote the air flow.

Referring to FIG. 5, the horizontal widths of the slide link slots 185 are denoted as y1 through y6, respectively, and the vertical heights thereof are denoted as x1 through x6, respectively. In the case of six slots 185, the widths x1–x6 and heights y1–y6 have relationships of $x1<x2<x3<x4<x5<x6$ and $y1<y2<y3<y4<y5<y6$ so as to adjust the opening angle of the automatic suction grille 141 when the links have reached their final blade-opening position.

Under such defined relationships, opening angles of the blades 190 assume the relationship of $\alpha1<\alpha2<\alpha3<\alpha4<\alpha5<\alpha6$, as shown in FIG. 6. Namely, the lower blades have wider opening angles than the upper blades, producing a progressively greater opening angle of the automatic suction grille 141 from top to bottom.

The detailed operation of the automatic suction grille apparatus for the air conditioner according to the present invention will be now described below.

For operation of the air conditioner, rotation of the blower 165 by the motor action takes in the room air through the suction inlet 140, followed by the opening of the automatic suction grille 141. In opening the grille 141, the pinion 198 is rotated by the driving motor 195, and elevates the sliding link 180. With the elevation of the sliding link 180, the blade moving shaft 194 of each blade 190 is upwardly moved along an arc within the blade moving shaft receiving slot 174.

The blade fixing shaft 192 of the blade 190, which is pivotally fixed in the blade fixing shaft hole 172 of the suction grille frame 170, functions as an axis of rotation, and thereby the suction inlet 140 can be opened. Moreover, each blade 190 of the present invention can be opened with different opening angles for the blades 190. Namely, as shown in FIG. 6, the lower blades have wider opening angles than those of the upper blades.

At the time of stopping the air conditioner, the motor M and thus blower 165 are stopped, and then the driving motor 195 is rotated in the reverse direction, causing the pinion 198 to be reversely rotated accordingly. Then, the reverse rotation of the pinion 198 lowers the sliding link 180, which closes the suction co inlet 140. This is because the blade moving shaft 194 of each blade 190 is downward moved along the arc of the blade moving shaft receiving slot 174.

As described above, the present invention provides an effective adjustment of the introduced air.

What is claimed is:

1. An air conditioner, comprising:

a cabinet forming an air inlet and an air outlet;

a heat exchanger disposed in the cabinet for changing the temperature of air flowing from the air inlet to the air outlet;

a U-shaped grille frame fixedly secured to the cabinet adjacent the air inlet, the grille frame including a pair of parallel vertical legs disposed on opposite sides of the air inlet, each leg including a plurality of vertically spaced holes, and a plurality of vertically spaced crescent-shaped slots arranged adjacent respective ones of the holes;

a pair of sliding links disposed adjacent to respective ones of the legs, the links movable simultaneously relative to the legs, each link including vertically spaced straight slots, each straight slot inclined obliquely relative to vertical, a vertical edge of each link including a vertical toothed rack;

a plurality of air-guiding blades mounted to the frame and extending across the air inlet, each blade including opposite ends connected to respective ones of the legs and to respective ones of the links such that movement of the links causes the blades to pivot between inlet-opening and inlet-closing positions, each end of each blade having first and second shafts extending therefrom, the first shaft mounted in a respective one of the holes to define a blade pivot axis, the second shaft mounted in a respective crescent-shaped slot and in a respective straight slot, the first shafts of each slot being horizontally aligned, and the second shaft being horizontally aligned;

pinions meshing with respective toothed racks; and motors for simultaneously rotating respective ones of the pinions to raise and lower the links and cause the second shafts to be raised and lowered by the respective straight slots and travel along the respective crescent-shaped slots to rotate the blades about the respective first shafts.

2. The air conditioner according to claim 1 wherein the links are vertically movable to a final blade-opening position in which all of the blades are at their maximum open state, the straight slots being of different respective lengths to pivot respective ones of the blades by different angles such that the air inlet becomes opened by progressively greater amounts from top to bottom when all of the links are in the final blade-opening position.

3. The air conditioner according to claim 1 wherein each of the legs forms a channel in which a respective one of the links is disposed for vertical sliding movement.

* * * * *